US007380688B2

(12) United States Patent
Fore

(10) Patent No.: US 7,380,688 B2
(45) Date of Patent: Jun. 3, 2008

(54) HAND-HELD ADHESIVE LABEL DISPENSER

(76) Inventor: Robert Scott Fore, 414 E. Maxwell St., Lakeland, FL (US) 33803

( * ) Notice: Subject to any disclaimer, the term of this patent is extended or adjusted under 35 U.S.C. 154(b) by 620 days.

(21) Appl. No.: 10/359,795

(22) Filed: Feb. 7, 2003

(65) Prior Publication Data

US 2004/0155052 A1 Aug. 12, 2004

(51) Int. Cl.
*B65H 5/00* (2006.01)

(52) U.S. Cl. ..... 221/235; 221/232

(58) Field of Classification Search ..... 221/235, 221/232; 156/384
See application file for complete search history.

(56) References Cited

U.S. PATENT DOCUMENTS

| | | | | | |
|---|---|---|---|---|---|
| 374,509 | A | * | 12/1887 | Thum | 211/50 |
| 1,072,859 | A | * | 9/1913 | Kingsley | 221/59 |
| 2,361,730 | A | * | 10/1944 | Avrick | 206/225 |
| 2,905,174 | A | * | 9/1959 | Smith | 602/42 |
| 3,370,747 | A | * | 2/1968 | Desmond | 221/26 |
| 3,816,221 | A | * | 6/1974 | Shank, Jr. | 156/492 |
| 4,160,352 | A | * | 7/1979 | Neff | 53/136.1 |
| 4,191,306 | A | * | 3/1980 | Rabner | 221/33 |
| 4,240,854 | A | * | 12/1980 | Massey et al. | 156/157 |
| 4,256,237 | A | * | 3/1981 | Desmond | 221/26 |
| 4,416,392 | A | * | 11/1983 | Smith | 221/45 |
| 4,439,262 | A | * | 3/1984 | Zodrow et al. | 156/364 |
| 4,586,630 | A | * | 5/1986 | Loder | 221/46 |
| 4,619,726 | A | * | 10/1986 | Cook et al. | 156/366 |
| 4,653,666 | A | * | 3/1987 | Mertens | 221/45 |
| 4,853,068 | A | * | 8/1989 | Becker | 156/384 |
| 4,954,208 | A | * | 9/1990 | Hamisch et al. | 156/577 |
| 4,986,524 | A | * | 1/1991 | Meintzer et al. | 271/100 |
| 5,165,570 | A | * | 11/1992 | Windorski et al. | 221/46 |
| 5,209,374 | A | * | 5/1993 | Seidl-Lichthardt | 221/73 |
| 5,271,522 | A | * | 12/1993 | Ko et al. | 221/58 |
| 5,363,985 | A | * | 11/1994 | Cornell | 221/46 |
| 5,417,345 | A | * | 5/1995 | Smith | 221/33 |
| 5,466,897 | A | * | 11/1995 | Ross et al. | 181/131 |
| 5,607,539 | A | * | 3/1997 | Kuppersbusch | 156/364 |
| 5,671,866 | A | * | 9/1997 | Bodziak | 221/45 |
| 5,807,619 | A | * | 9/1998 | Freedman | 428/35.7 |
| 5,863,384 | A | | 1/1999 | Reddy | |
| 5,875,715 | A | * | 3/1999 | Hamisch et al. | 101/288 |
| 6,079,190 | A | * | 6/2000 | Simpson | 53/492 |
| 6,138,734 | A | | 10/2000 | Hamisch, Jr. | |
| 6,238,510 | B1 | * | 5/2001 | Callahan et al. | 156/324 |
| 6,241,289 | B1 | * | 6/2001 | Kulper et al. | 283/86 |
| 6,648,173 | B2 | * | 11/2003 | Crawford | 221/63 |
| 6,680,098 | B1 | * | 1/2004 | Aakermann | 428/40.1 |

(Continued)

*Primary Examiner*—Patrick H. Mackey
*Assistant Examiner*—Michael E. Butler
(74) *Attorney, Agent, or Firm*—McHale & Slavin, P.A.

(57) ABSTRACT

The instant invention proposes to utilize pre-cut unbacked labels releasably attached to one another in a stacked arrangement within a disposable tube having one open end. The labels have a diameter approximately equal to the inside diameter of the tube and have adhesive on one side with the adhesive sides facing the open end of the tube. A spring biased compression mechanism at the closed end of the tube serves to urge the stack of labels-toward the open end of the tube. When the outward-facing label contacts the object to be labeled, the label is released from the stack and adheres to the object exposing the next label in the stack.

21 Claims, 7 Drawing Sheets

U.S. PATENT DOCUMENTS 6,719,472 B2 * 4/2004 Windorski et al. ..... 401/195
6,830,795 B1 * 12/2004 Downs ..... 428/40.1
6,884,312 B2 * 4/2005 Mitchell et al. ..... 156/277
2004/0004014 A1 * 1/2004 Grossman ..... 206/440

* cited by examiner

HAND-HELD ADHESIVE LABEL DISPENSER

FIELD OF THE INVENTION

This invention relates to a hand-held labeling device ("labeler"); particularly to a disposable tubular labeler containing having a plurality of unbacked labels in a stacked arrangement; and most particularly to a hand-held labeler which provides substantially increased labeling speed.

BACKGROUND OF THE INVENTION

In the modern assembly-line production of products for the mass market, as well as in the end retail market, an important stage is the labeling of the product. Although a good deal, and often all, of the information needed on the package (UPC, source identification, etc.) can be printed on the wrapping material itself, there often remains the need to affix other labels. These labels include in particular, but are not limited to, point of origin, theft-mitigation tags and the like. Such labels are often applied by the end retailer, either to the outside of the product or to the outside of the product's packaging. Recently, large retailers have begun to require that these labels be already affixed when the products arrive from the manufacturer or wholesale-distributor. Labelers for products such as fruit or vegetables are well known. A number of devices are available which peel self-adhesive labels from a backing material and apply the label to fruit and vegetables as well as other products. Known prior art devices utilize a continuous composite strip of non-adhesive backing material having a plurality of pre-cut labels releasably attached thereto. The devices fall into two broad general categories, they are either the hand-held type used by retailers or specialized machinery used by manufacturers. Both the hand-held and the specialized equipment are designed with a concentration on increasing the speed of peeling away the backing material and placing the label on the product without sacrificing accuracy or reliability.

Specialized labelers are also known which are designed to apply labels quickly to a specific size and/or type of product, e.g. apples, melons, tomatoes, cans, bottles etc. Specialized labelers are of four general types: vacuum, blow-on, tamp-apply, and laid-on. The vacuum or bellows type labelers typically have a number of applicators arrayed around a circular head. Labels are stripped from a continuous web of backing material and, as each label is stripped, a respective one of the applicators uses vacuum to pick up the label and stick the adhesive side of the label to the product. The adhesive overcomes the relatively weak vacuum such that the label adheres to the product. The second type of automatic labeler is a "blow-on" or compressed air labeler in which the label is peeled from the backing material and a burst of compressed air blows the label onto the product. The third labeler type is a "tamp-apply" labeler in which labels are peeled from the backing and tamped onto the product with a piston-type applicator. Finally, the fourth type of automatic labeler is a "laid-on" labeler in which a peel blade is positioned at the end of an articulating labeling arm. A continuous web of labels are threaded past the peel blade and selectively advanced when a product is sensed on the conveyor. Individual labels are stripped from the continuous label web by the peel blade and pushed into contact with the product by a sponge roller or the like.

Although the specialized labeling equipment listed above does have the ability to apply labels rapidly, it also has a number of disadvantages. These disadvantages include the cost of the equipment, set-up time, space requirements, and the training and salary demanded by specialized personnel. Since the labeling machines are especially designed for one product type and size, or at best a narrow range of types and sizes, various parts of the machine must be changed if one wishes to use the labeling machine with another label or for a different product. Although this drawback may not be a problem for industries where products or containers do not vary, it creates significant drawbacks in certain industries. This is especially true of the fruit and vegetable industry where every piece is slightly different and shapes are irregular.

Hand-held type labeling devices in the past have typically been used at the retail level to apply price tags and the like. Hand-held type labeling devices have also been disclosed for applying adhesive postage stamps and sale labels to flat surfaces. These devices typically utilize the same type of coiled composite webbing material as the specialized machinery. Like the specialized machines, the hand-held labelers must separate the self-adhesive material from the backing material before attachment. To separate the layers the operator usually squeezes the handle of the device operating the mechanisms. The non-adhesive backing material must be rewound or torn away to continue use. Due to their cumbersome nature, these devices are generally avoided for large volume applications.

To be practical, hand-held devices generally have a limited size and space available. Most of this space is consumed by the mechanisms required to remove the backing material from the labels. To function properly, these machines must be loaded with the rolls of backing and adhesive material precisely threaded through the mechanisms. Normal wear and tear on the mechanisms requires continual maintenance and adjustment to maintain proper operation. The expense of hand-held labeler devices normally limits the number of hand labeling devices available at a location.

U.S. Pat. No. 5,863,384 discloses a postage stamp dispenser and applicator which utilizes self-adhesive stamps on a roll of backing material. The mechanism includes a stamp roll holding chamber, a stamp conveyor platen with a separator at its end for separating the stamps from the backing paper, a backing paper spooler, and a ratchet wheel for rotating the spooler.

U.S. Pat. No. 4,954,208 discloses a hand-held labeler which uses labels loosely adhered to a carrier web. A strip of labels on the carrier web are wound onto a label supply roll. The carrier web is guided through the body of the labeler to where a de-laminator successively de-laminates labels from the carrier web and an applicator applies the labels. A winder having a spindle or spool is manually rotated to wind the label carrying web onto a take-up roll.

U.S. Pat. Nos. 5,875,715 and 6,138,734 disclose hand-held labelers for printing and applying labels which are adhered to a carrier web in a roll form. The device peels the labels from the non-adhesive carrier web before they can be placed on the desired product.

Accordingly, what is lacking in the art is a disposable hand-held labeling device in which individual unbacked labels are utilized in a stacked arrangement and are fed and applied to products without the need for mechanisms designed to peel away a backing material.

SUMMARY OF THE INVENTION

The objectives are accomplished in accordance with the invention by the provision of a disposable hand-held labeling device constructed in the form of a tube with one open end and a stack of unbacked labels disposed therein.

The prior art generally utilizes specialized equipment or hand-held labeling devices to peel self-adhesive labels from a roll of backing material to be placed on the desired surface. The instant invention proposes to utilize pre-cut unbacked labels releasably attached to one another in a stacked arrangement within a disposable tube having one open end. The labels have a shape which approximates the interior shape of the tube and have adhesive on one side with the adhesive sides facing the open end of the tube. A spring biased compression mechanism at the closed end of the tube serves to urge the stack of labels toward the open end of the tube. When the outward-facing label contacts the object to be labeled, the label is released from the stack and adheres to the object.

By utilizing the aforementioned construction, labels can be easily and quickly attached to fruits and vegetables or other products without the need to set-up and operate a piece of specialized equipment designed to peel away a backing layer before applying the label. Additionally, the device does not need to be reloaded; therefore, high volumes of labels can be quickly attached by hand. In addition, the instant invention gives the user the ability to cost effectively attach labels to irregularly shaped objects, for example fruit and/or vegetables.

An essential component of the instant invention is the use of pre-cut unbacked labels in a stacked arrangement. The labels are spring biased toward the open end of the disposable tube where they are positioned, with the adhesive side outward, and held in place by engagement means, for example a small lip which provides frictional interference about the perimeter of the opening. To attach a label, the adhesive is merely touched to the desired surface. The attachment between the adhesive and the surface overcomes the attachment between the labels and pulls the label from the tube revealing the next label in the stack. The process can be continued until the stack of labels in the tube is depleted.

Accordingly, a primary objective of the instant invention is to teach a hand-held label applicator in which individual unbacked labels are utilized in a stacked arrangement.

Another objective of the instant invention is to teach a non-refillable hand-held label applicator wherein the applicator container is disposable.

Yet another objective of the instant invention is to teach a hand-held label applicator in which variously shaped unbacked labels are placed in a stacked arrangement.

Still another objective of the instant invention is to teach a hand-held label applicator capable of placing labels on irregularly shaped surfaces.

Still yet another objective of the instant invention is to teach a hand-held label applicator that does not require mechanisms to peel away a backing layer before the label can be placed on the desired object.

Other objectives and advantages of this invention will become apparent from the following description taken in conjunction with the accompanying drawings wherein set forth, by way of illustration and example, certain embodiments of this invention.

The drawings constitute a part of this specification and include exemplary embodiments of the present invention and illustrate various objectives and features thereof.

DETAILED DESCRIPTION OF THE PREFERRED EMBODIMENT

Figure 1:
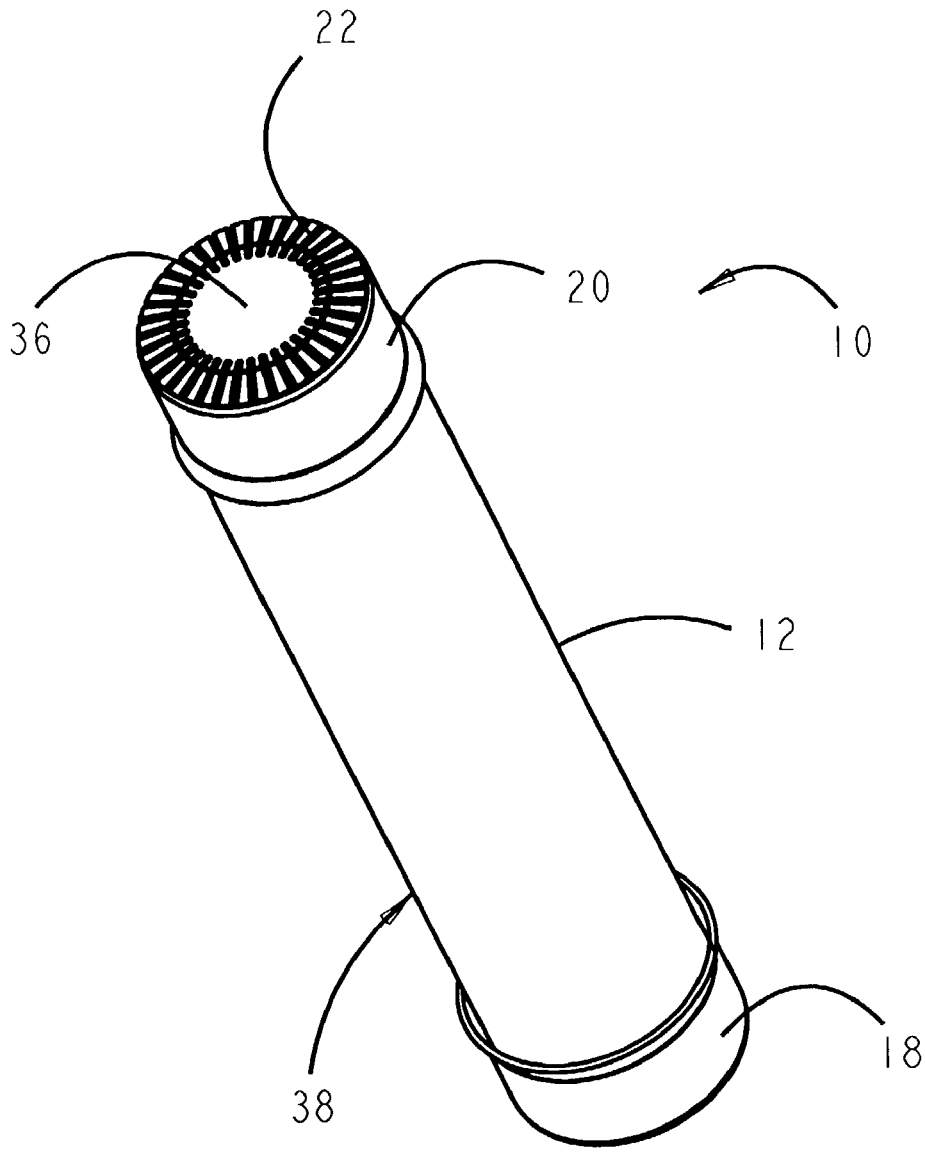
FIG. 1 is an isometric view illustrating the instant invention.
Figure 2:
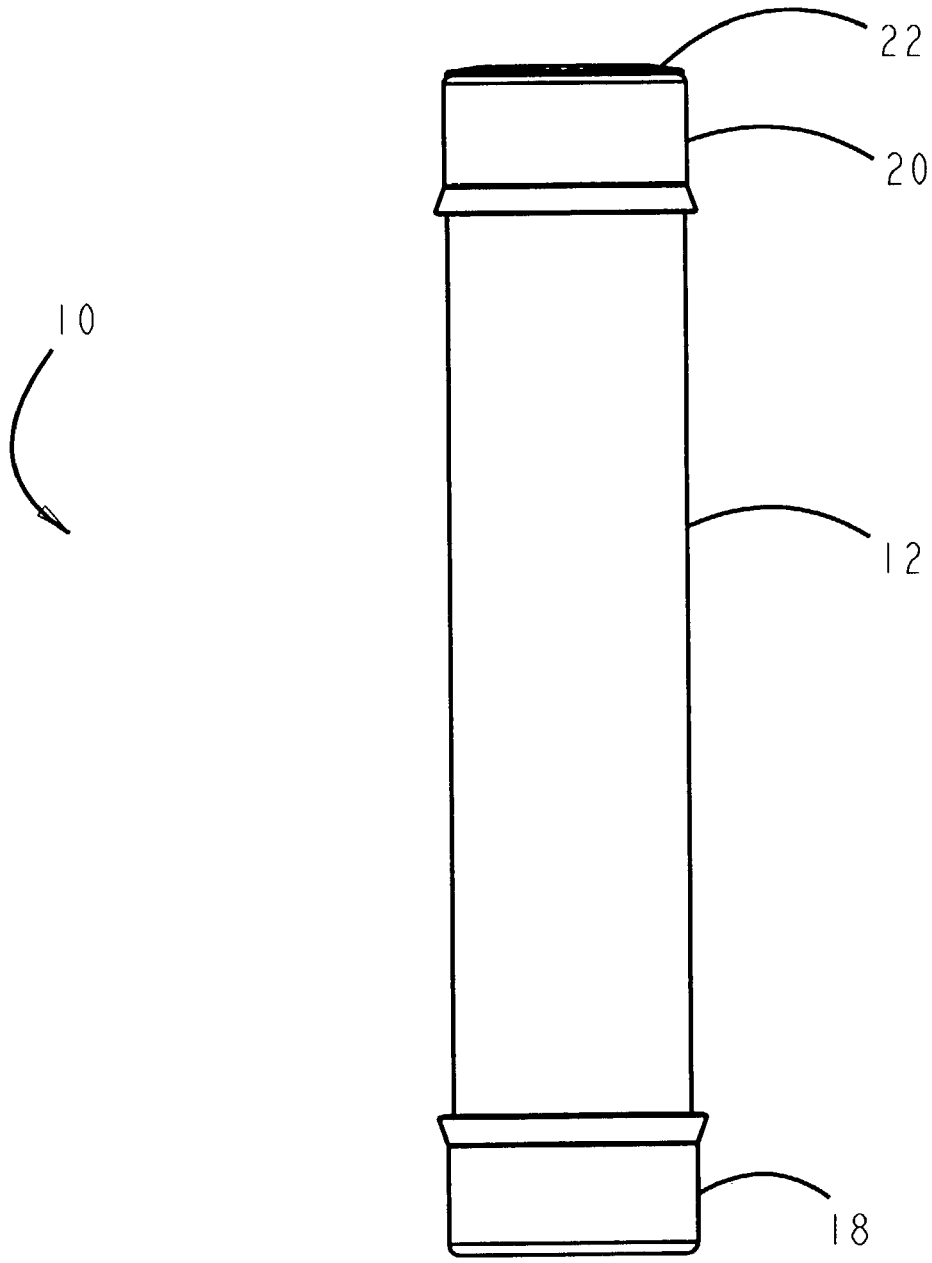
FIG. 2 is a plane side view of the instant invention.
Figure 3:
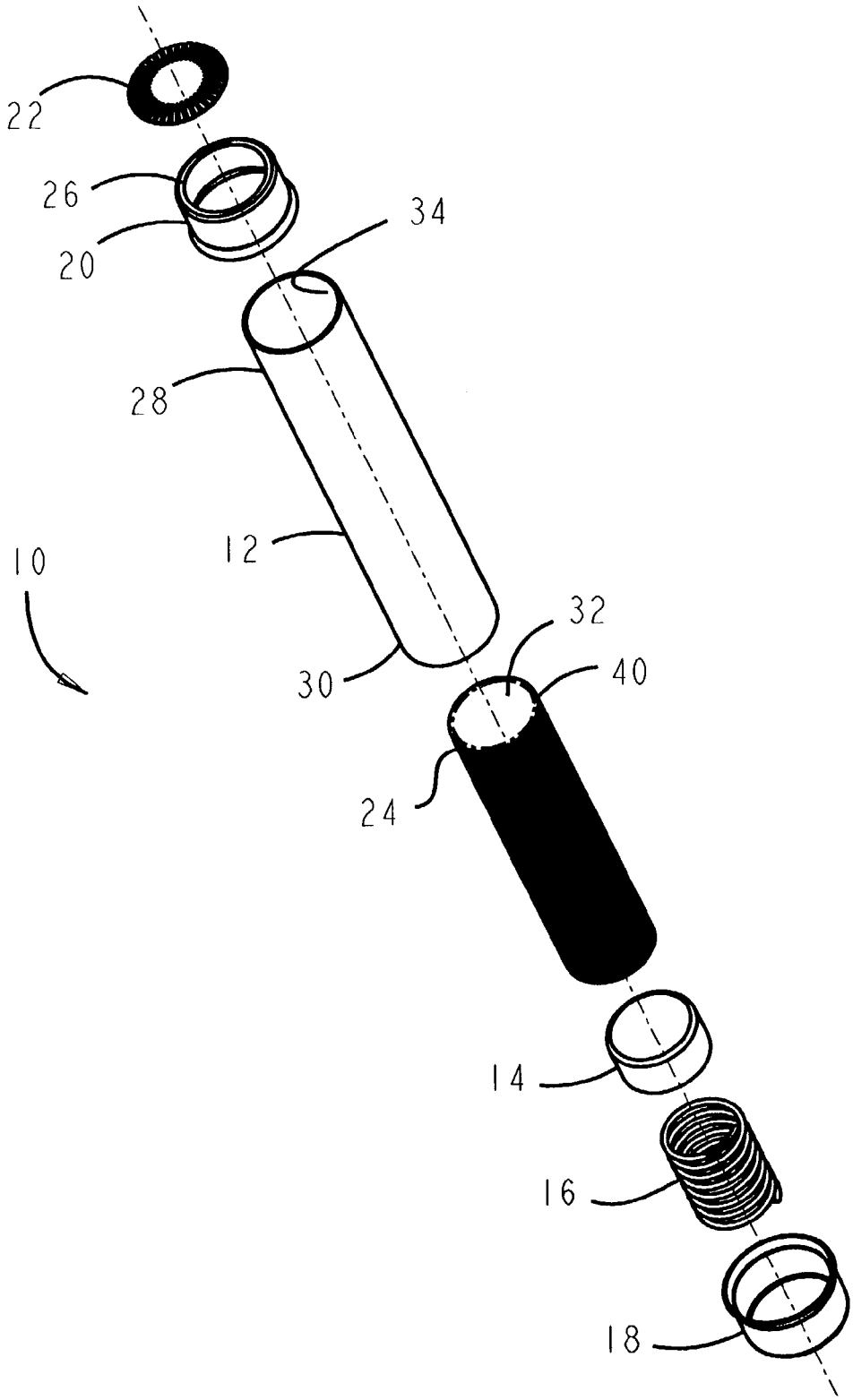
FIG. 3 is an exploded isometric view of the instant invention.

Referring now to FIGS. 1-3, illustrated is the hand-held labeling device of the present invention. The hand-held labeling device 10 comprises a means for storing a supply of self-adherent unbacked articles in a stacked arrangement illustrated as: a label supply assembly 38, a supply of self-adherent unbacked articles illustrated as labels 24, and a means for urging the supply of self adherent unbacked articles toward an apply point illustrated as: a piston member 14 and a spring member 16.

The hand-held labeling supply assembly 38 is constructed and arranged to contain the labels 24 in a stacked arrangement and present the first label 24 in the stack at a label apply point 36. The label supply tube 12 is preferably constructed with a length and inside bore 34 for containing a stack of unbacked labels 24. Preferably the inside bore 34 of tube member 12 is constructed with a shape that corresponds to the shape of the stack of unbacked labels 24, while the outside of the label supply tube 12 is preferably round. The open end cap 20 is constructed and arranged for cooperative attachment to the first end 28 of label supply tube 12. The open end cap 20 is preferably constructed as a sleeve for engaging the outside diameter of the supply tube 12 with a label engagement means illustrated as an inwardly depending lip 26 having the same general shape and a slightly smaller bore diameter than the diameter of the unbacked labels 24. This permits the open end cap 20 to releasably retain the stack of labels while positioning the end label 24 for application. The closed end cap 18 should be constructed and arranged for cooperative attachment to second end 30 of label supply tube 12 and is preferably constructed as a sleeve having a closed end. The means for urging the supply of self adherent unbacked articles toward the apply point 36 are illustrated herein as: a piston member 14 and piston compression means, illustrated by, but not limited to a spring member 16. The piston member 14 is constructed and arranged to slide within the bore 34 of the label supply tube 12. The spring member 16 is positioned between the closed end cap 18 and the piston 14 to apply pressure to the back side of the piston member 14 urging the piston member 14 toward the open end cap 20. A cover 22 is removably attached to the open end cap 20 for preventing labels 24 from being inadvertently applied. The cover 22 is preferably constructed of a relatively thin flexible material such as cellophane, paper or the like. The tube 12, open end cap 20, piston 14, and closed end cap 18 are preferably, but not limited to, being constructed of a disposable or recyclable material, e.g. plastic, paper, aluminum or the like.

Although the self-adherent unbacked articles are depicted as labels 24, it is understood that the term label is exemplary. In the preferred embodiment the label material utilized is manufactured by Fasson Roll North America, part numbers 50#FM Litho/Z3000/40# SCK. It is within the purview of the instant invention to substitute various tapes, stamps, transfers or the like. Furthermore, while the indicia is exemplified as being printed on the exemplary labels, such indicia may be combined with the substrate carrier in any manner known in the art, e.g. embossed, impregnated, laser enhanced, holographic indicia, hidden in a manner to prevent counterfeiting, or the like. The labels may have one or more unique shapes, and are self-adherent to an object upon which it is affixed. The labels 24 preferably have a shape and size approximately equal to the inside bore 34 of the label supply tube 12. The labels 24 have adhesive on a first side 32, and may have indicia on a second side, and are loosely adhered to one another in a stacked arrangement with the adhesive sides 32 facing the apply point opening 36 in the open end cap 20. In a non-limiting embodiment the second side of the label may also include a release agent such as silicone and the like. Release agents are well known in the art and may be utilized in a variety of ways such as, a separate coating applied over the ink, incorporated directly into the ink, or incorporated into the substrate material in manner that allows it to exude from the substrate over time. Such a release agent is currently manufactured by General Electric and is sold under the part numbers UV9300 and UV9390C. Preferably the first side of the labels 24 have a masked area 40 extending around the perimeter of their adhesive side 32 free from adhesive or having a deadened adhesive. Adhesive deadening agents are well known in the art. Such an adhesive deadner is currently manufactured by Arcar Graphics of Ann Arbor, Mich. and sold under part number WX005B020H. The masked area 40 should generally correspond in size and shape to the area of the label 24 contacted by the depending lip 26 of the open end cap 20. The masked area 40 and the optional release agent allow the labels 24 to be easily pulled from the apply point 36 when the adhesive side 32 of a label 24 is touched to a corresponding surface.

Figure 4:
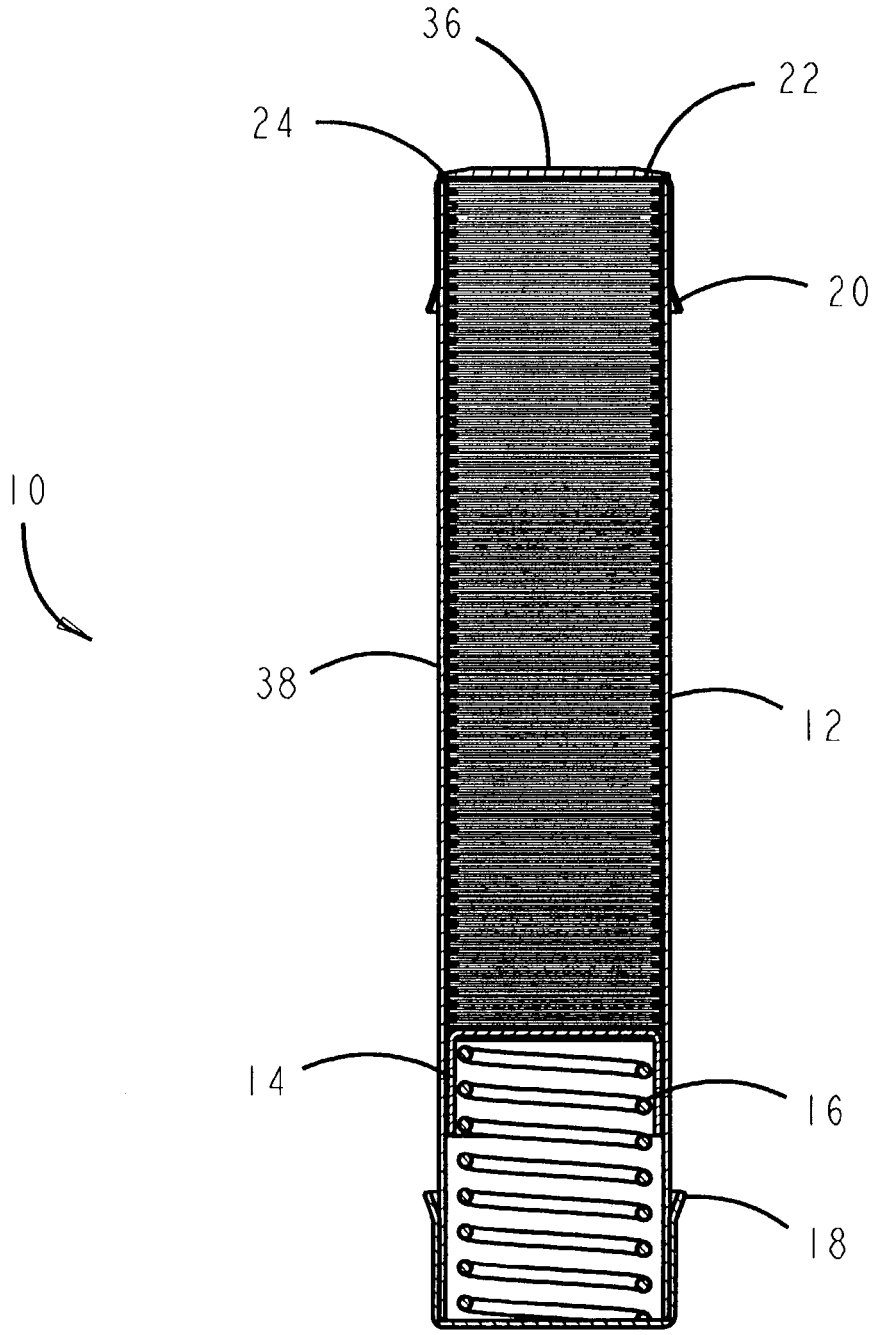
FIG. 4 is a section view along lines 1-1 of the instant invention.

Referring to FIG. 4, the hand-held label applicator is illustrated as being sectioned along its centerline. The preloaded design of the hand-held labeling device 10 allows the user to grasp the tube 12, remove the cellophane cover 22 and begin attaching labels 24 by pressing the exposed adhesive side 32 of the end label 24 at the apply point 36 to a desired surface. This causes the label 24, due to the adhesive, to stick to the desired surface and be released by the labeler 10. Once a label 24 is attached to a surface and pulled from the stack the piston 14 and the spring member 16 urge the next label 24 to the apply point 36. The labeler 10 can then be moved to the next desired surface for attachment of another label 24 until the stack 38 is depleted.

Figure 5:
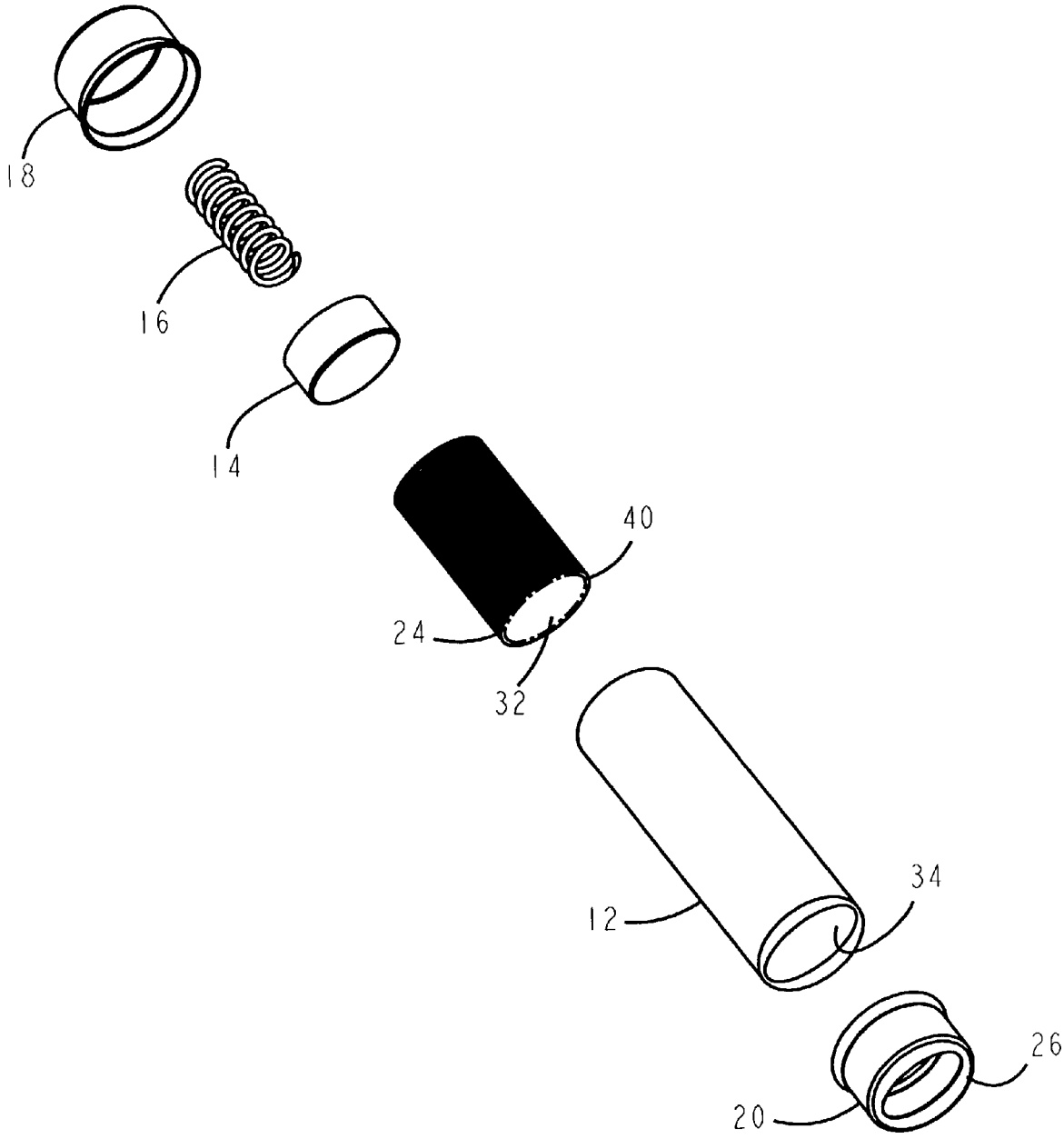
FIG. 5 illustrates an alternative embodiment of the instant invention wherein the labels have an oval shape.
Figure 6:
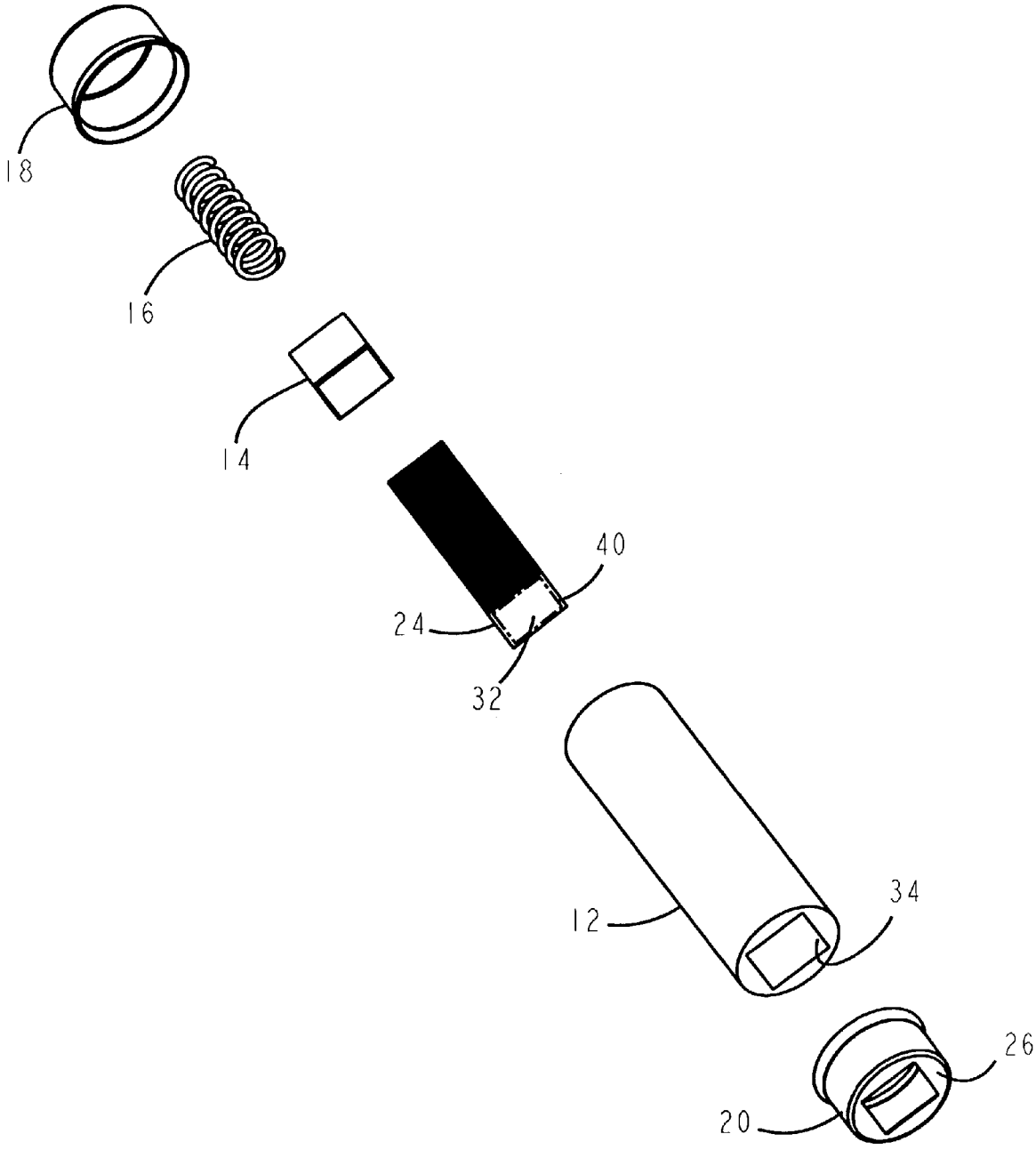
FIG. 6 illustrates an alternative embodiment of the instant invention wherein the labels have a rectangular shape.
Figure 7:
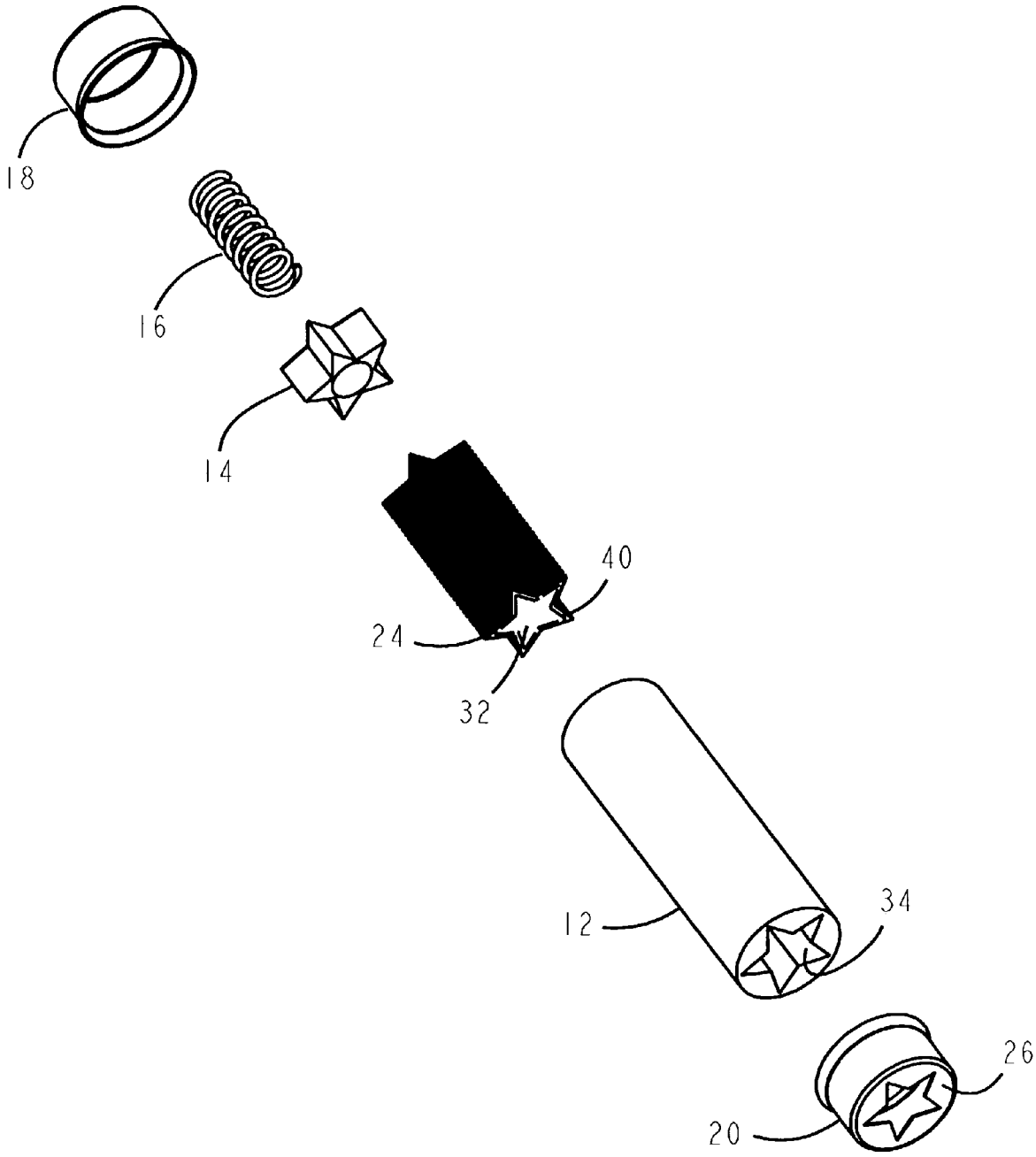
FIG. 7 illustrates an alternative embodiment of the instant invention wherein the labels have a star shape.

Referring to FIGS. 5-7, alternative embodiments of the hand-held label applicator 10 are illustrated. In the alternative embodiments the inside bore 34 of the tube 12 has a conjugate shape to the labels 24 and the piston member 14. The conjugate shape maintains the stacked arrangement and allow the labels to be aligned and guided within the tube. The labels 24 used in the instant invention are preferably round, but can be made in any suitable shape including but not limited to oval, square, rectangular, star shaped.

All patents and publications mentioned in this specification are indicative of the levels of those skilled in the art to which, the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

I claim:

1. A hand-held applicator device comprising a plurality of self-adherent unbacked articles in a stacked axially aligned arrangement, each of said self-adherent unbacked articles including a first adhesive surface and a second non-adhesive surface, wherein said second non-adhesive surface of each self-adherent unbacked article is positioned adjacent to the first adhesive surface of the next successive self-adherent unbacked article, said stacked self-adherent unbacked articles being placed within a supply tube including an inner bore constructed and arranged to guide and maintain said axial alignment of said stacked self-adherent unbacked articles, said supply tube having a first open end configured for releasably retaining and applying said self-adherent unbacked articles, by way of a centrally located open apply point aperture, said supply tube having a second closed end, a means for urging said first adhesive surface of said stacked self-adherent unbacked articles toward said apply point aperture, said means for urging positioned between said second closed end and a lowermost stacked self-adherent unbacked article, said first adhesive surface of an uppermost self-adherent unbacked article being exposed within said apply point aperture, so that contacting said exposed first adhesive surface of said uppermost self-adherent unbacked article to a surface releases said uppermost self-adherent unbacked article from said stack thereby exposing said first adhesive surface of a successive self-adherent unbacked article.

2. The hand-held applicator device of claim 1 wherein said self-adherent unbacked articles are labels, each said label having indicia on at least one of said first or said second surfaces.

3. The hand-held applicator device of claim 1 wherein said self-adherent unbacked articles are tape.

4. The hand-held applicator device of claim 1 wherein said open end of said supply tube includes an inwardly depending lip defining said apply point aperture, said inwardly depending lip constructed and arranged for releasably retaining said plurality of self-adherent unbacked articles within said apply point aperture so that said first adhesive surface is exposed there through.

5. The hand-held applicator device of claim 1 wherein said means for urging said plurality of stacked self-adherent unbacked articles toward said apply point aperture includes at least one spring member for biasing said self-adherent unbacked articles toward said apply point aperture of said supply tube.

6. The hand-held applicator device of claim 5, wherein said means for urging said self-adherent unbacked articles toward said apply point aperture further includes a piston member slidably mounted within said bore of said supply tube, said piston member positioned between said at least one spring member and said stack of self-adherent unbacked articles.

7. The hand-held applicator device of claim 4, wherein said first adhesive surface of each said self-adherent unbacked article includes an adhesive masked perimeter sized and shaped to approximate the size and shape of said inwardly depending lip, whereby said adhesive masked perimeter is substantially free of adhesive.

8. The hand-held applicator device according to claim 1, including a cover member releasably adhered to said first open end of said supply tube and covering said apply point aperture, whereby removing said cover member reveals said first adhesive surface of said uppermost self-adherent unbacked article.

9. The hand-held applicator device according to claim 1, wherein said supply tube contains about one thousand self-adherent unbacked articles in said stacked arrangement;

wherein said self-adherent unbacked articles are loosely adhered to one another in said stacked arrangement.

10. The hand-held applicator device according to claim 1, wherein said second non-adhesive surface of each said self-adherent unbacked article includes indicia thereon.

11. The hand-held applicator device according to claim 1, wherein each said self-adherent unbacked article includes embossing thereon.

12. The hand-held applicator device according to claim 1, wherein said second non-adhesive surface of each said self-adherent unbacked article includes holographic indicia thereon.

13. The hand-held applicator device according to claim 1 wherein each of said self-adherent unbacked articles has a perimeter approximately conjugate in size and shape to said bore of said supply tube.

14. The hand-held applicator device according to claim 13, wherein each of said self-adherent unbacked articles includes a round perimeter surface.

15. The hand-held applicator device according to claim 13, wherein each of said self-adherent unbacked articles includes an oval shaped perimeter surface.

16. The hand-held applicator device according to claim 13, wherein each of said self-adherent unbacked articles includes a rectangular shaped perimeter surface.

17. The hand-held applicator device according to claim 13, wherein each of said self-adherent unbacked articles includes a star shaped perimeter surface.

18. The hand-held applicator device according to claim 1, wherein at least a portion of said second non-adhesive surface of each said self-adherent unbacked article includes a release agent thereon for facilitating release of said uppermost self-adherent article from said stacked arrangement upon contacting said first adhesive surface to a corresponding desired surface.

19. The hand-held applicator device according to claim 18, wherein said release agent is applied as a surface coating across said second non-adhesive surface.

20. The hand-held applicator device according to claim 18, wherein said release agent is incorporated into indicia ink applied to at least a portion of said second non-adhesive surface.

21. The hand-held applicator device according to claim 18, wherein said self-adherent unbacked article is constructed and arranged to exude said release agent.

* * * * *